US008146848B2

(12) United States Patent
Sim et al.

(10) Patent No.: US 8,146,848 B2
(45) Date of Patent: Apr. 3, 2012

(54) PULVERIZER FOR FOOD WASTE TREATMENT APPARATUS

(75) Inventors: Sang Gu Sim, Gyeonggi-do (KR); Young Don Park, Incheon (KR); Sung Jin Kim, Seoul (KR)

(73) Assignee: Woongjin Coway Co., Ltd., Chungcheongnam-do (KR)

( * ) Notice: Subject to any disclaimer, the term of this patent is extended or adjusted under 35 U.S.C. 154(b) by 264 days.

(21) Appl. No.: 12/459,453

(22) Filed: Jun. 30, 2009

(65) Prior Publication Data

US 2010/0090040 A1 Apr. 15, 2010

(30) Foreign Application Priority Data

Oct. 14, 2008 (KR) ..... 10-2008-0100875

(51) Int. Cl.
*B02C 19/22* (2006.01)

(52) U.S. Cl. ..... 241/260.1; 241/285.1

(58) Field of Classification Search ..... 241/260.1, 241/285.1, 285.2, 285.3, 57
See application file for complete search history.

(56) References Cited

U.S. PATENT DOCUMENTS 4,713,256 A * 12/1987 Chaveron et al. ..... 426/631

FOREIGN PATENT DOCUMENTS

| | | | |
|---|---|---|---|
| CH | 650 898 | A5 | 8/1985 |
| CN | 1535761 | A | 10/2004 |
| EP | 0474538 | A1 | 3/1992 |
| KR | 2019980027505 | | 8/1998 |
| KR | 1020040045087 | | 6/2004 |
| KR | 10-2005-0018727 | | 2/2005 |
| WO | 2004/047995 | A1 | 6/2004 |
| WO | 2005/061134 | A1 | 7/2005 |

OTHER PUBLICATIONS

Chinese Patent Application No. 200910146293.3—"Notification of First Office Action", State Intellectual Property Office of PRC, May 13, 2011.

Notice of Allowance issued in corresponding Korean application (Jul. 7, 2011).

* cited by examiner

*Primary Examiner* — Mark Rosenbaum

(74) *Attorney, Agent, or Firm* — Peter F. Corless; Christine C. O'Day; Edwards Wildman Palmer LLP

(57) ABSTRACT

The present invention provides a pulverizer of a food waste treatment apparatus. The pulverizer of the present invention includes a main body, a pulverizing screw and an exhaust channel unit. The main body has a hollow space therein. The pulverizing screw includes a rotating shaft which is installed in the main body so as to be rotatable, and at least one drive blade which extends from the rotating shaft. The exhaust channel unit has an annular shape and is coupled to the upper end of the main body. An intake hole and an exhaust hole are formed through the outer surface of the exhaust channel unit. Furthermore, a cover may be removably coupled to the upper end of the exhaust channel unit.

17 Claims, 14 Drawing Sheets

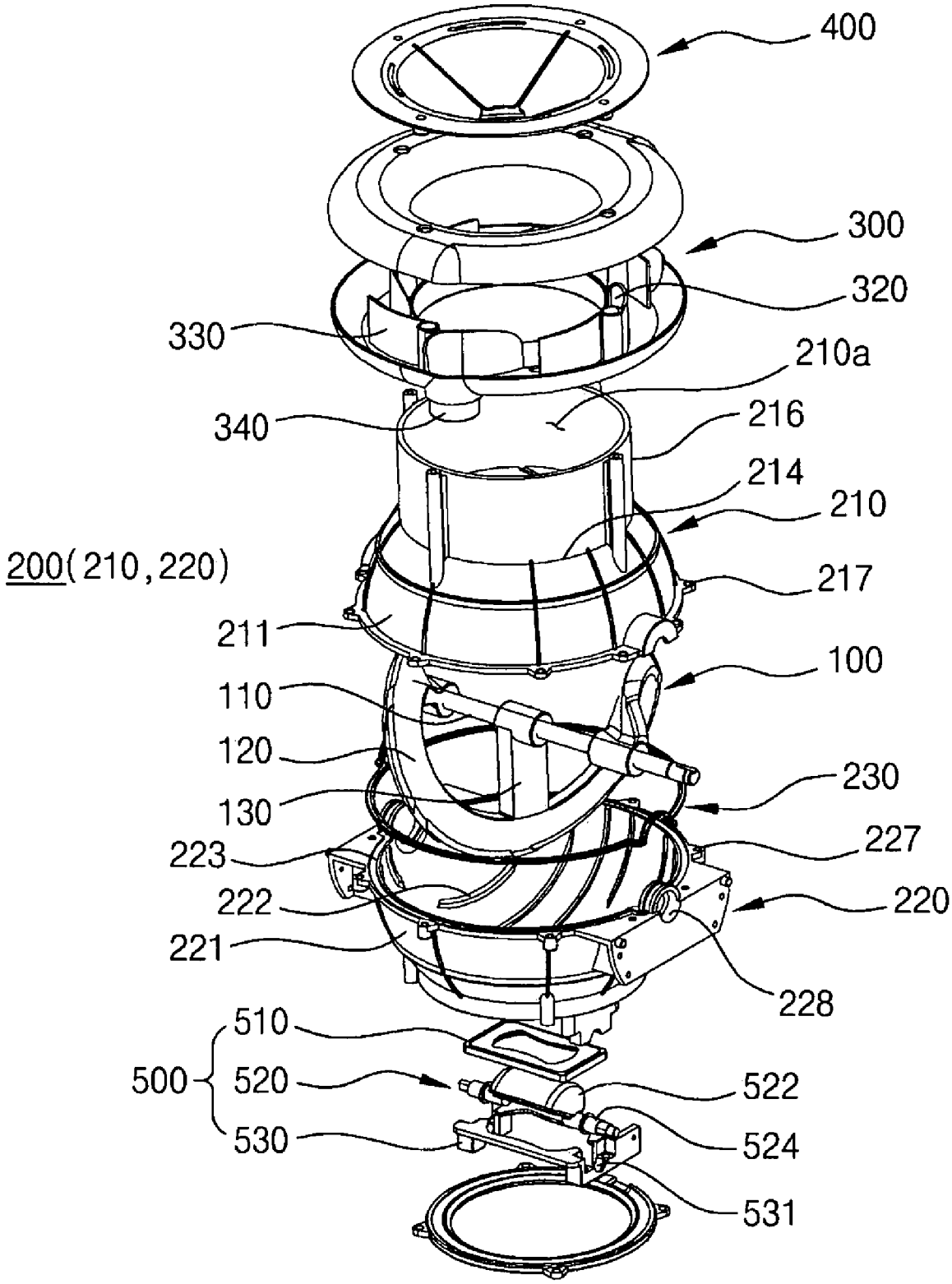
[FIG. 1]

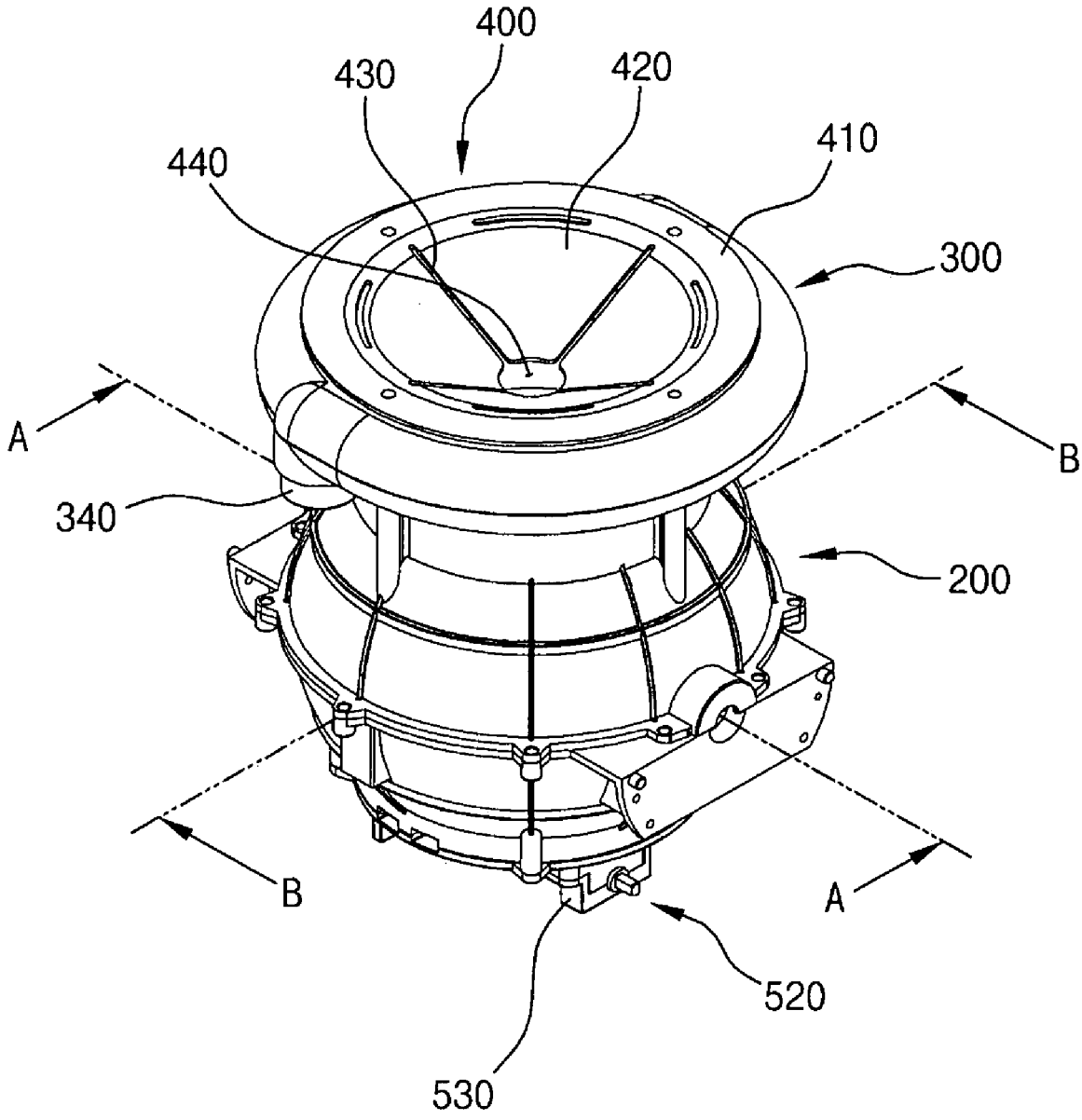
[FIG. 2]

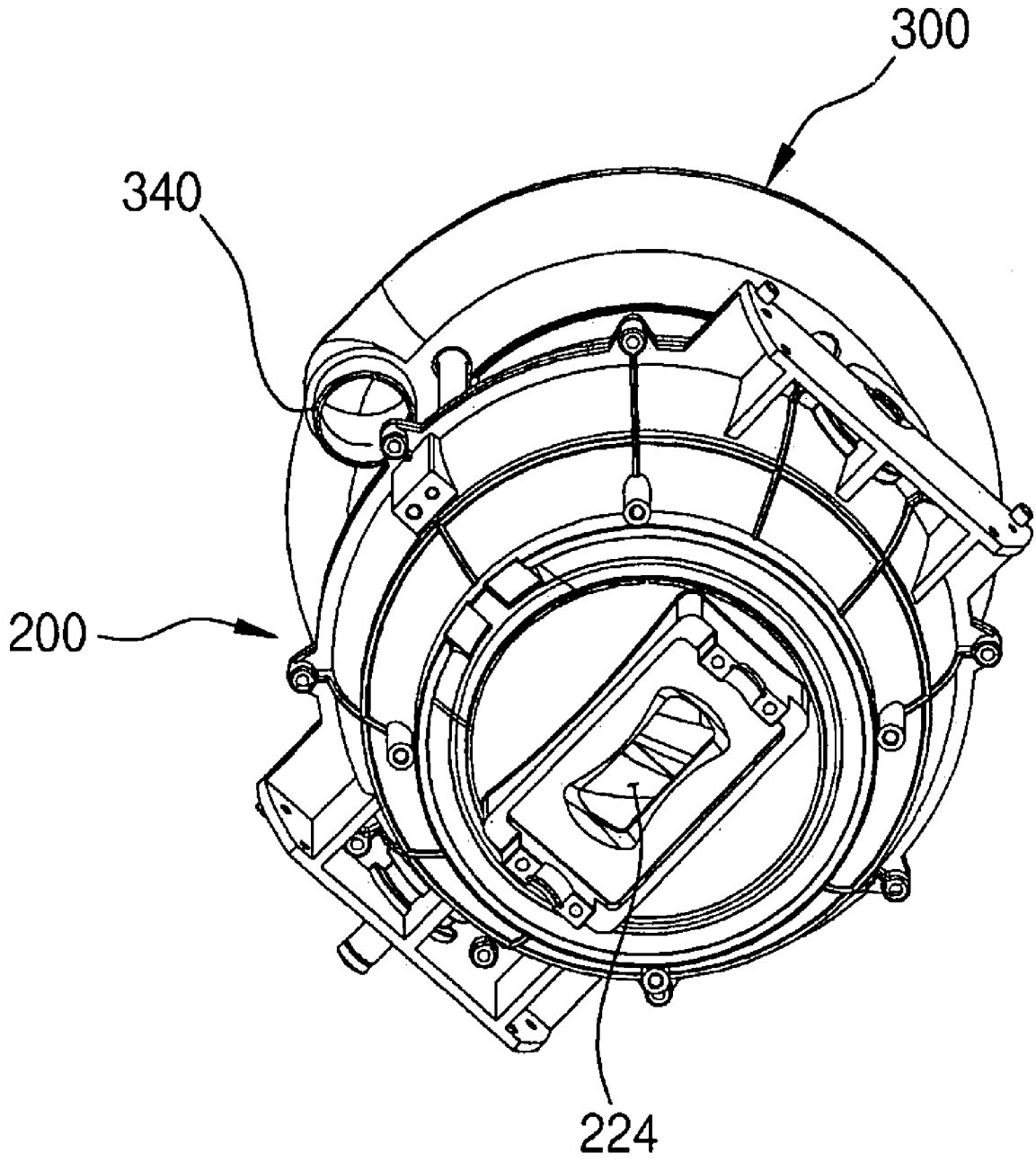
[FIG. 3]

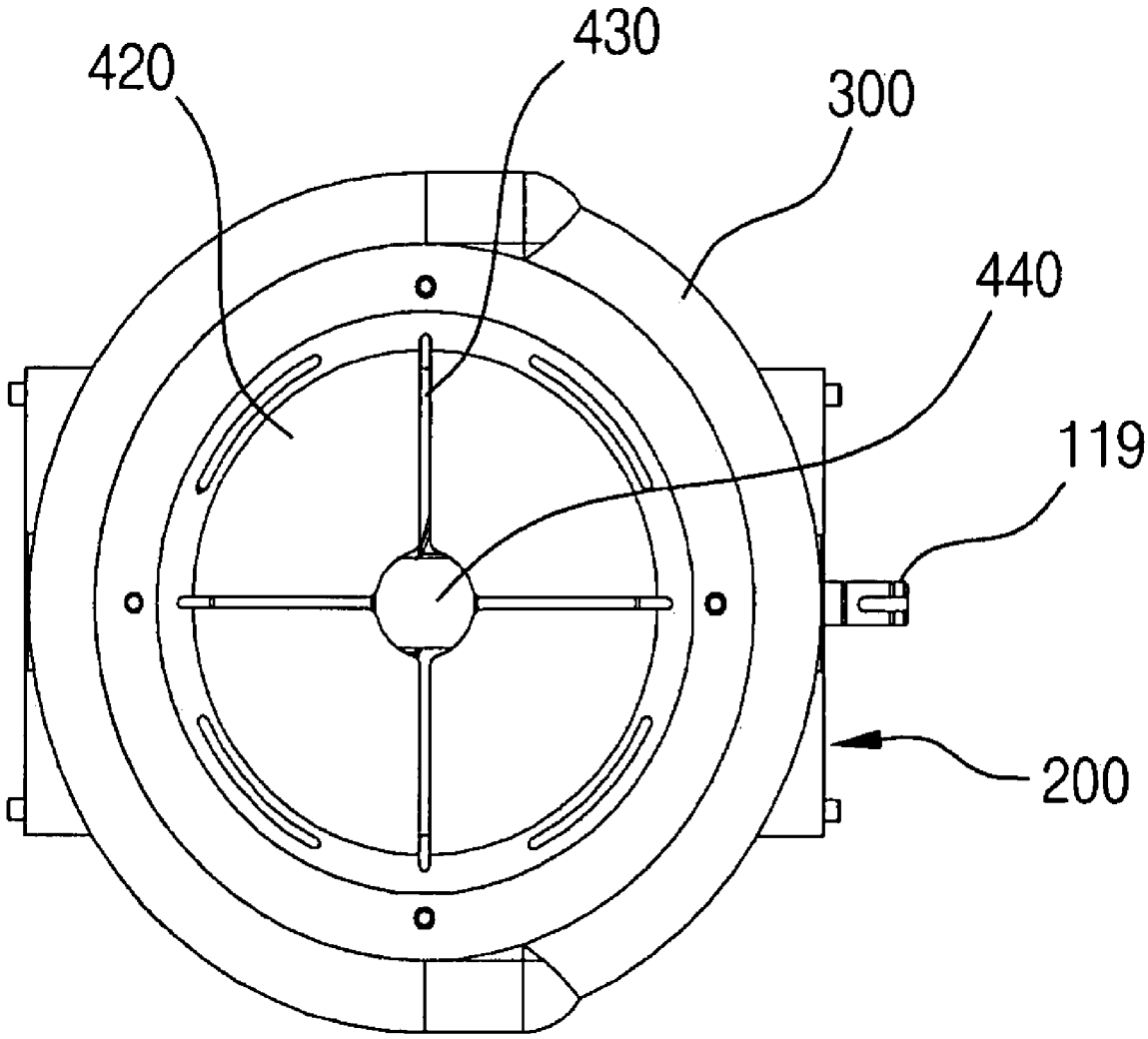
[FIG. 4]

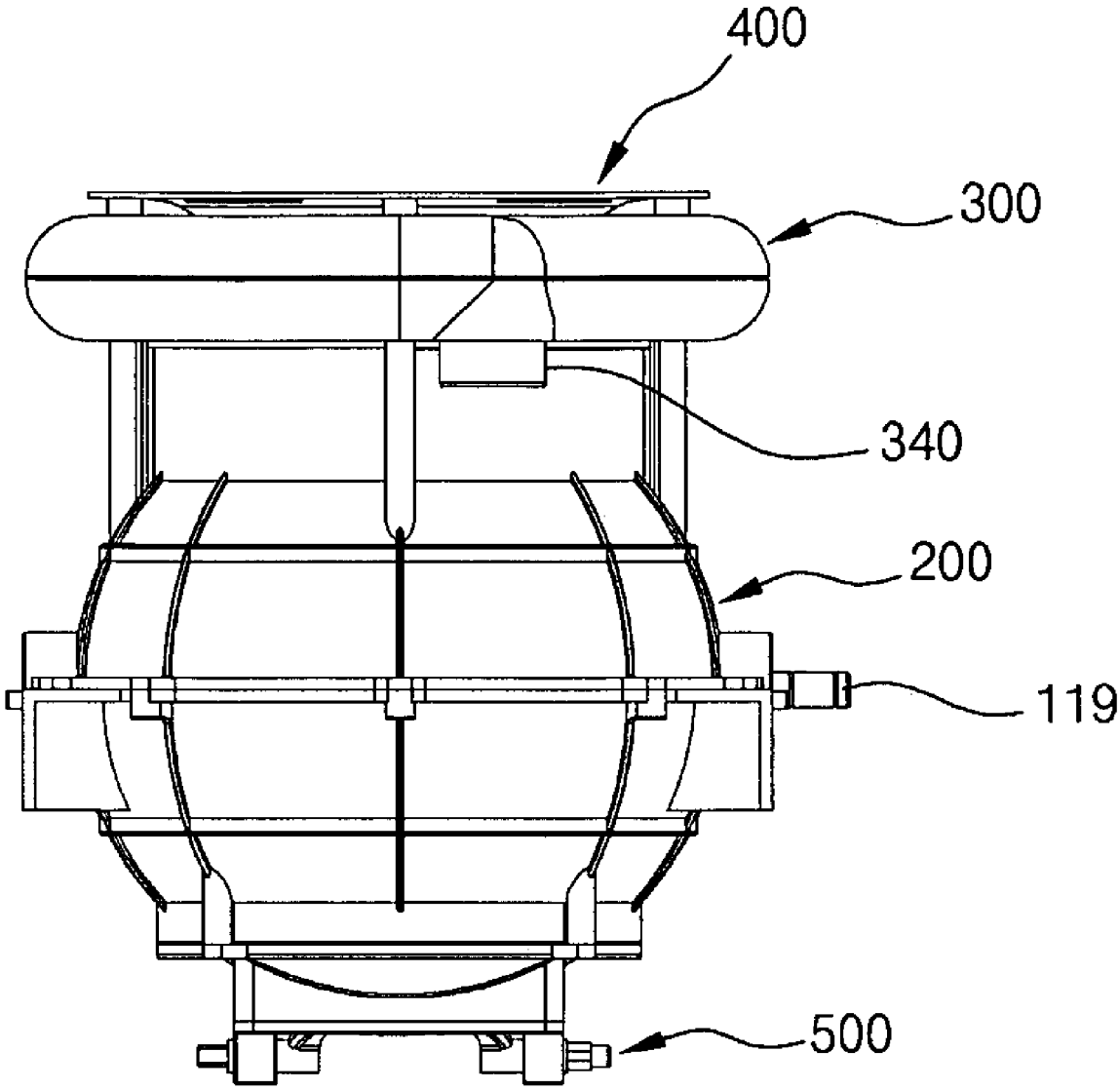
[FIG. 5]

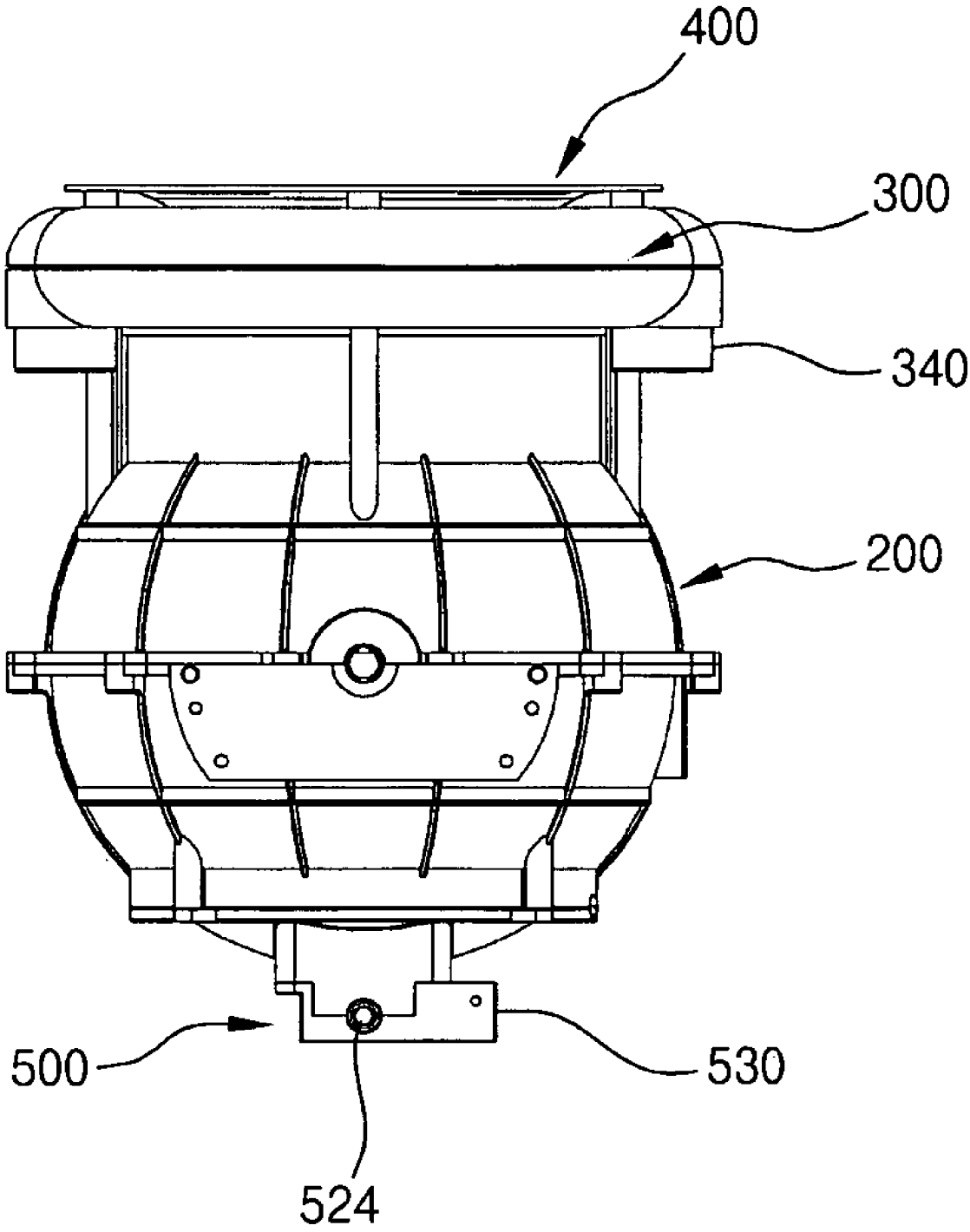
[FIG. 6]

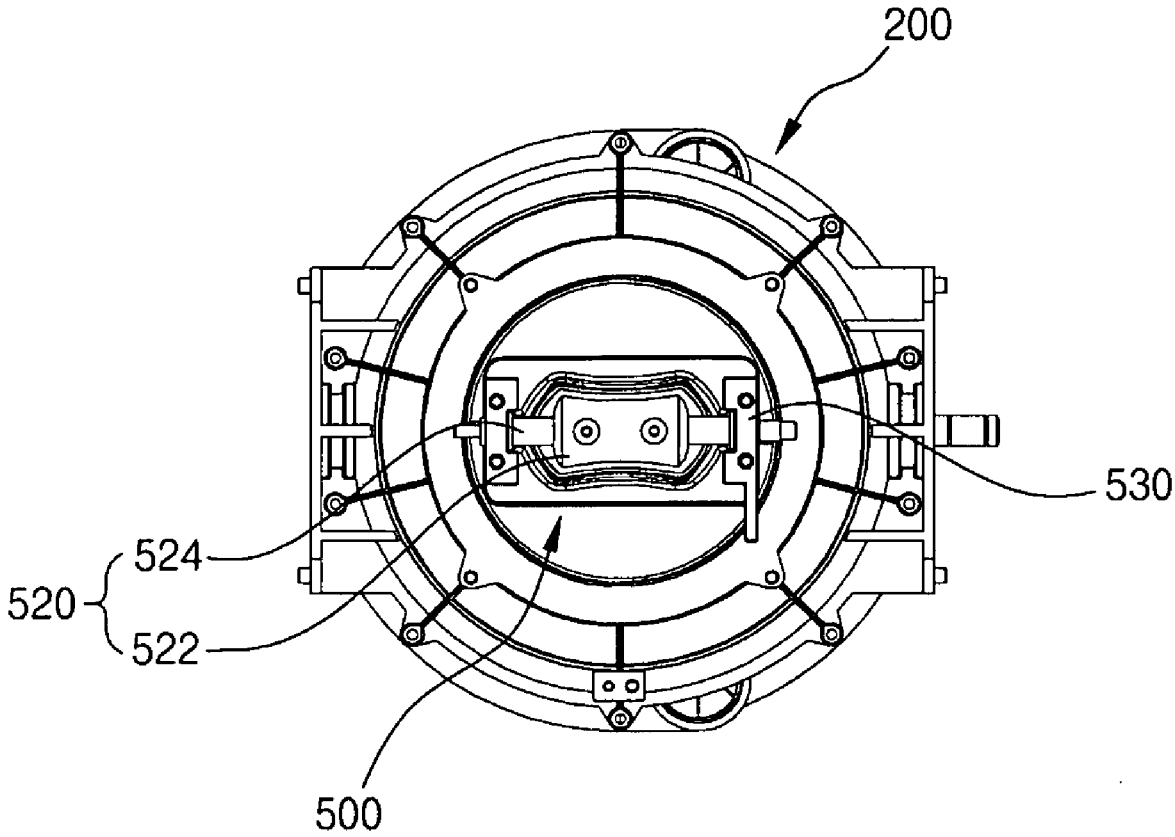
[FIG. 7]

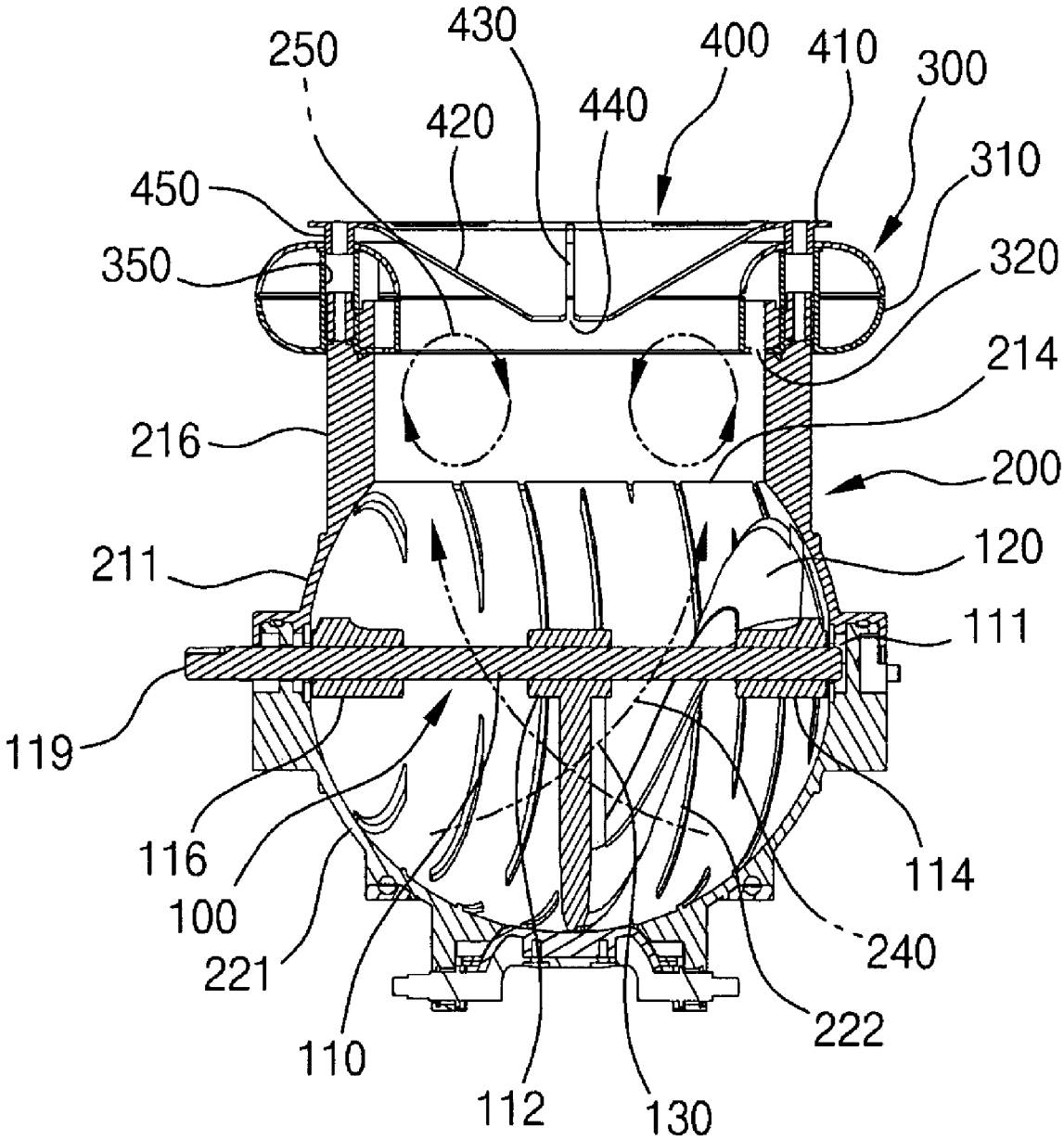
[FIG. 8]

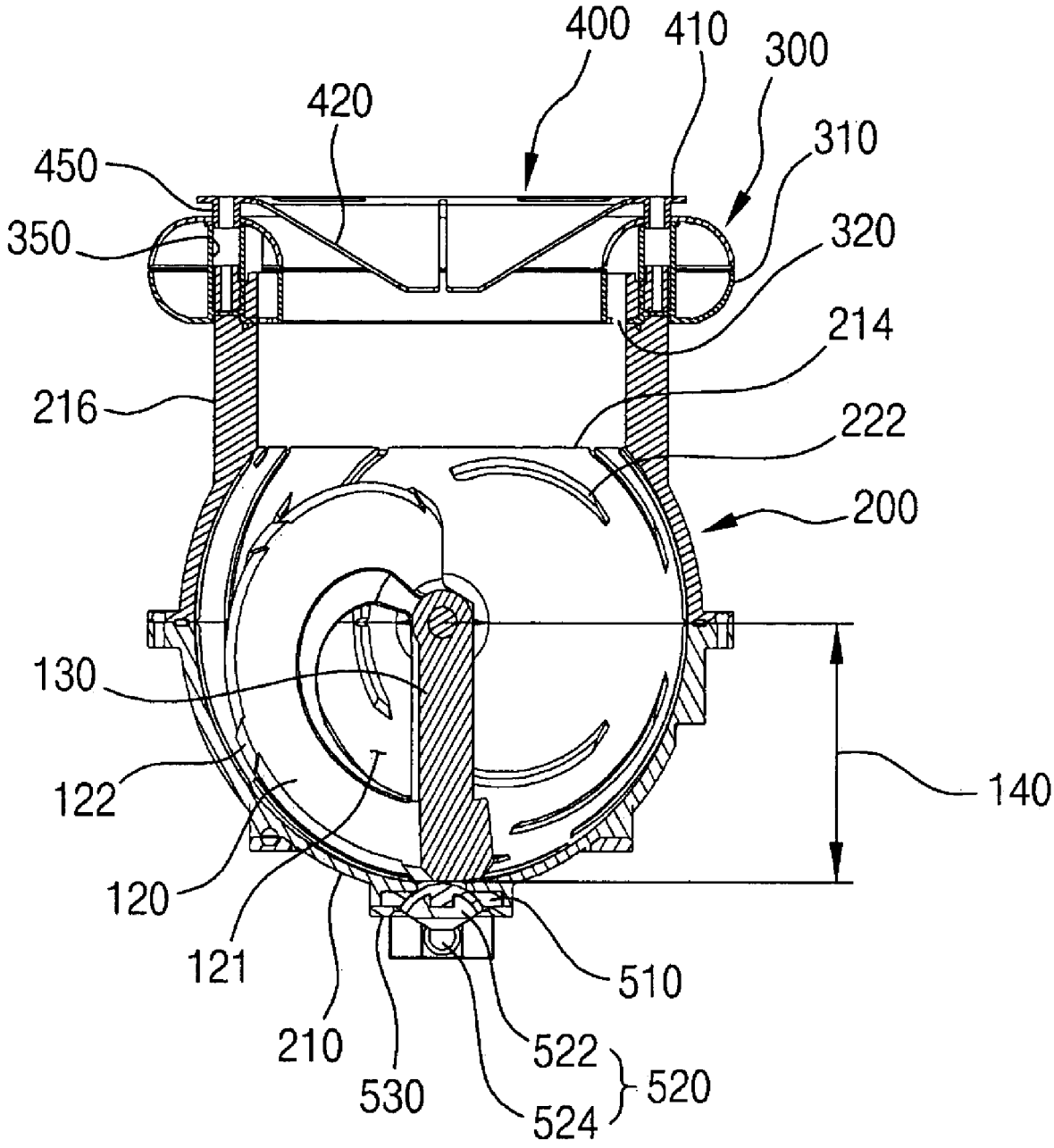
[FIG. 9]

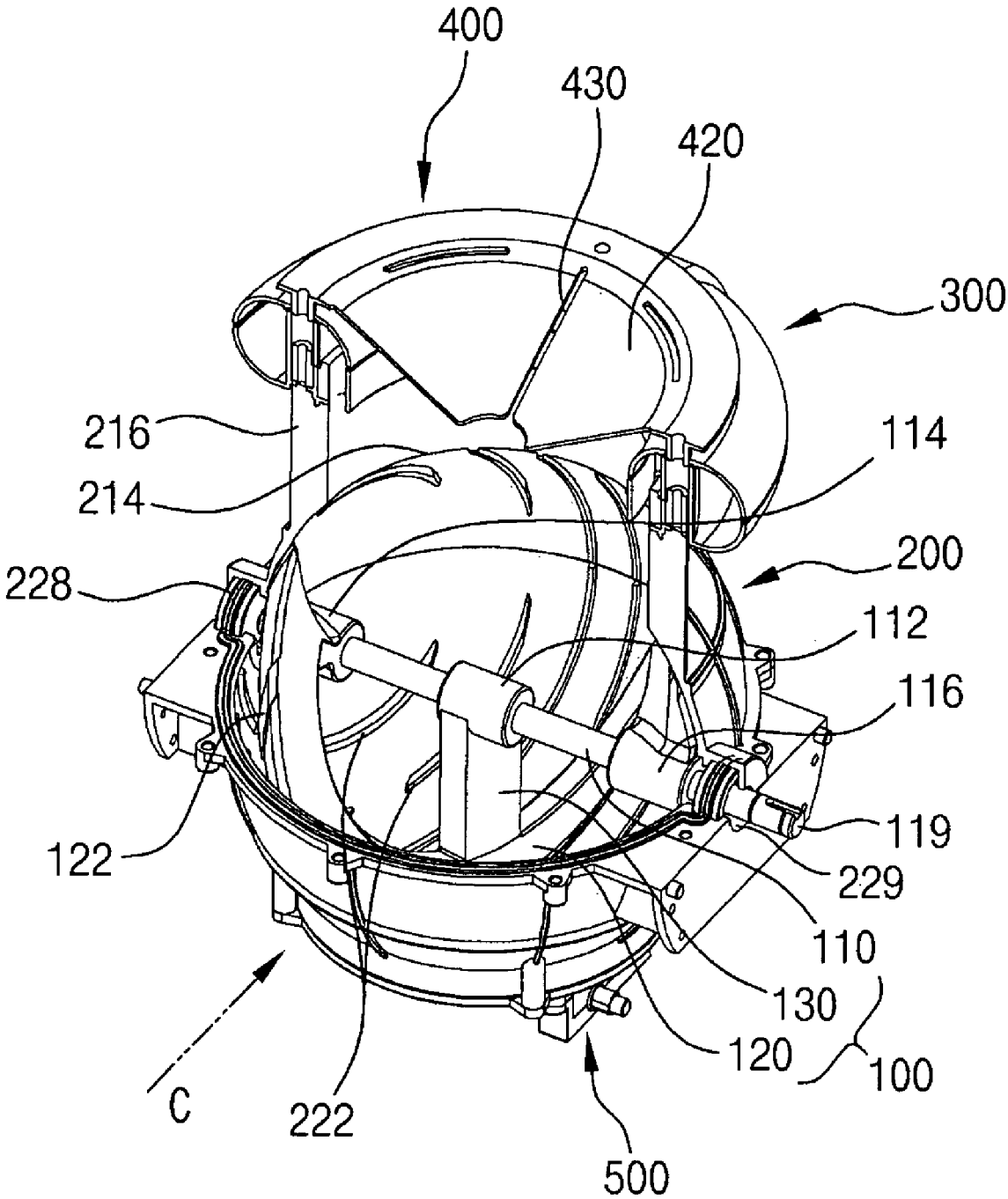
[FIG. 10]

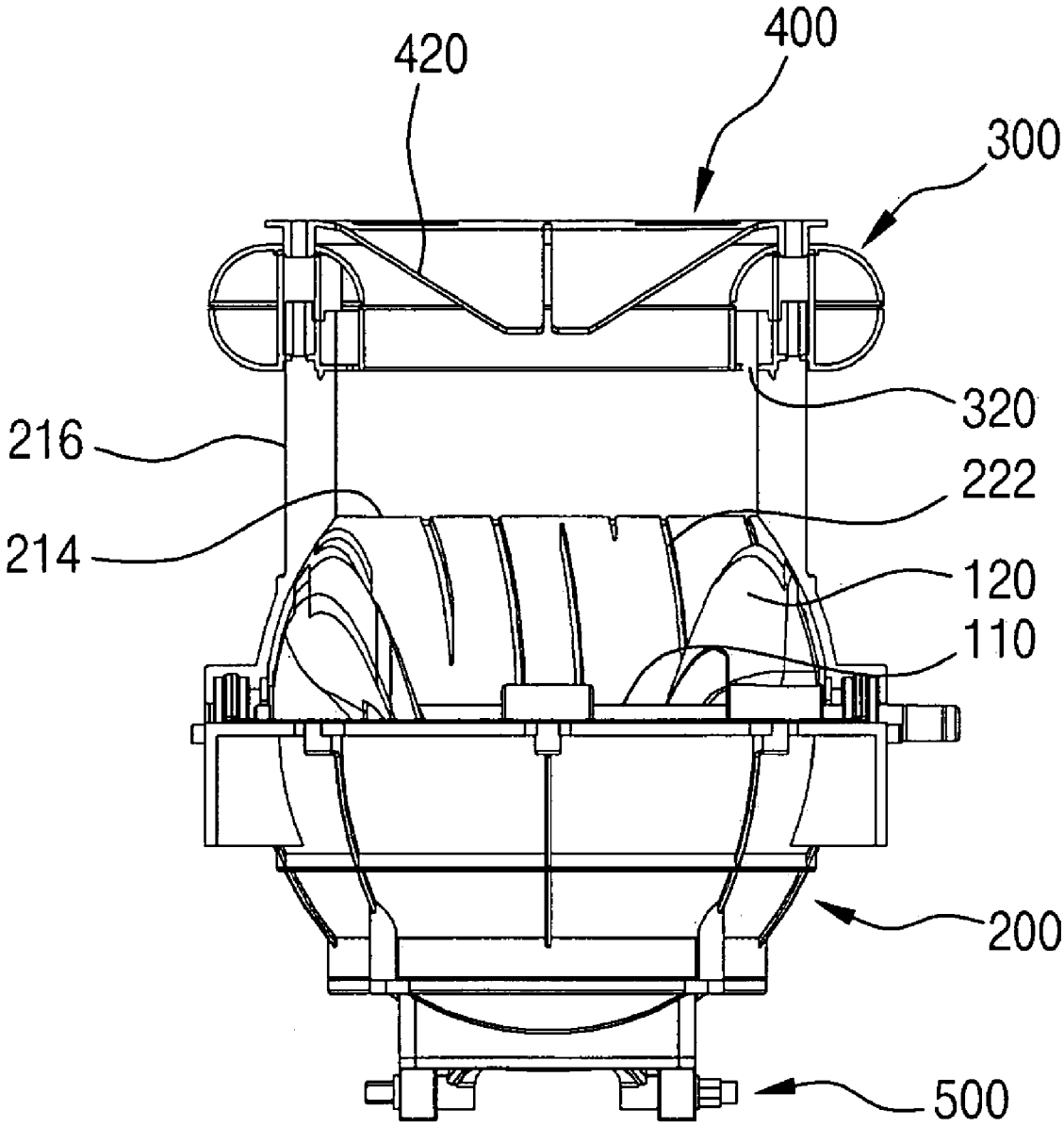
[FIG. 11]

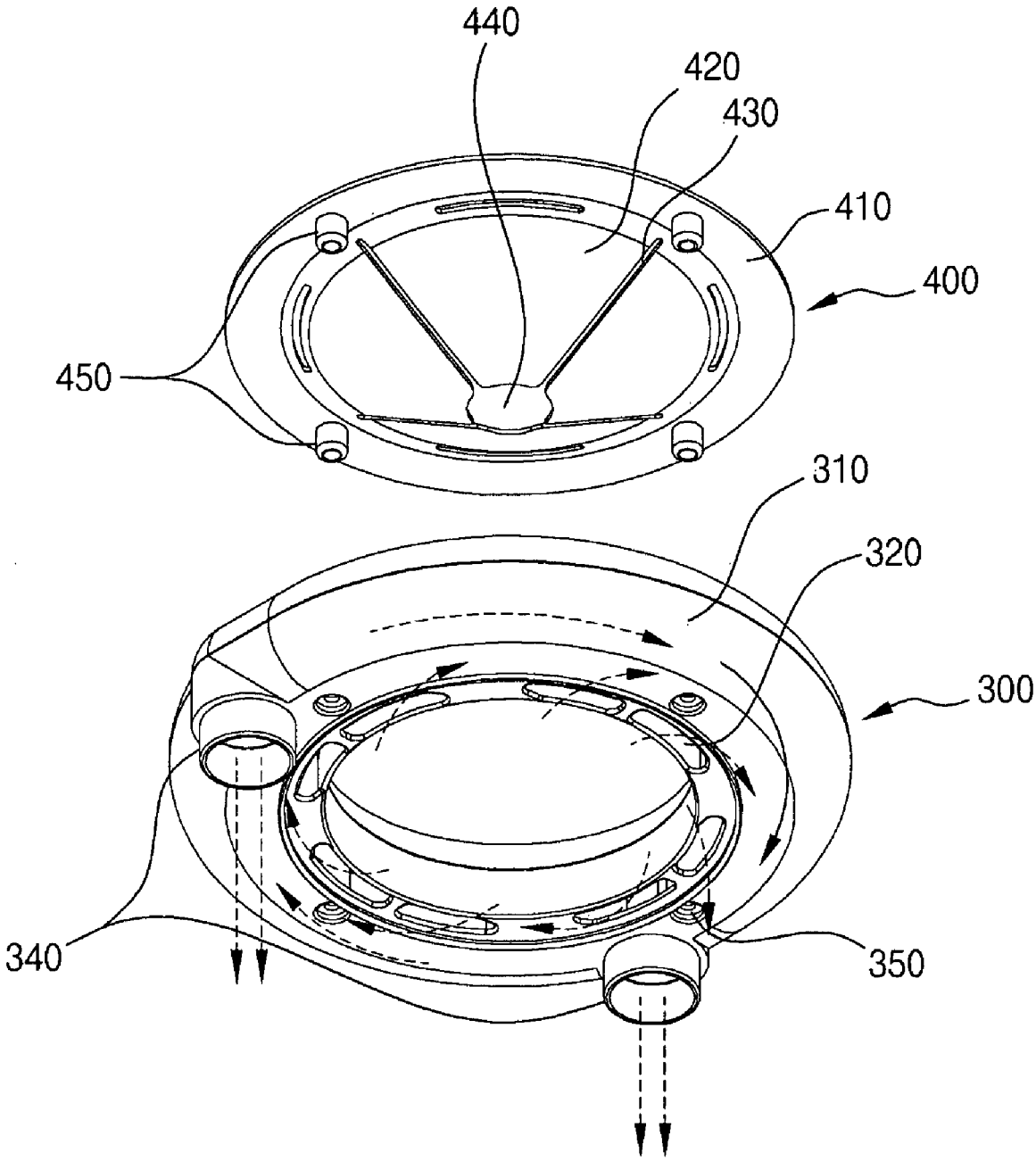
[FIG. 12]

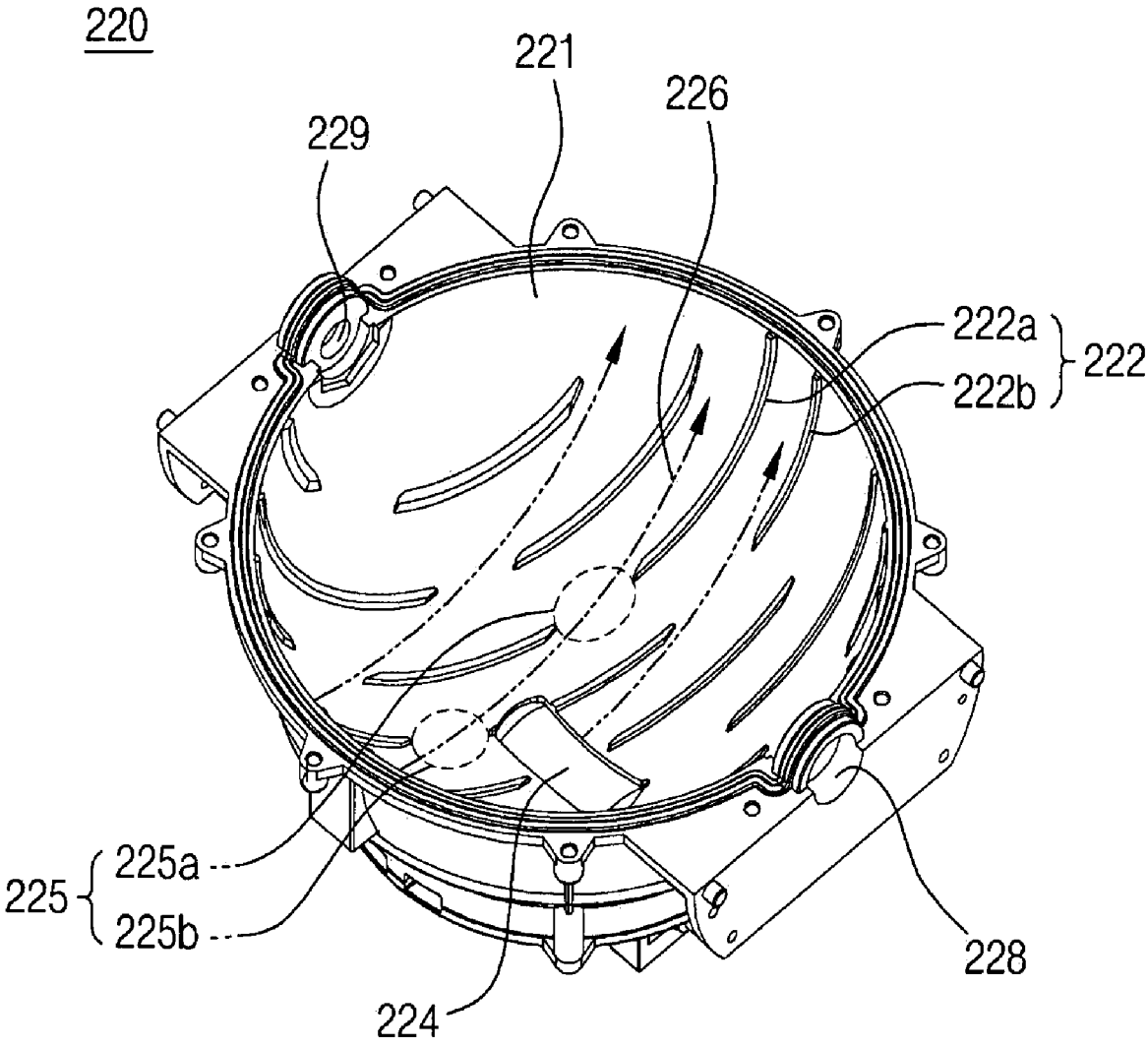
[FIG. 13]

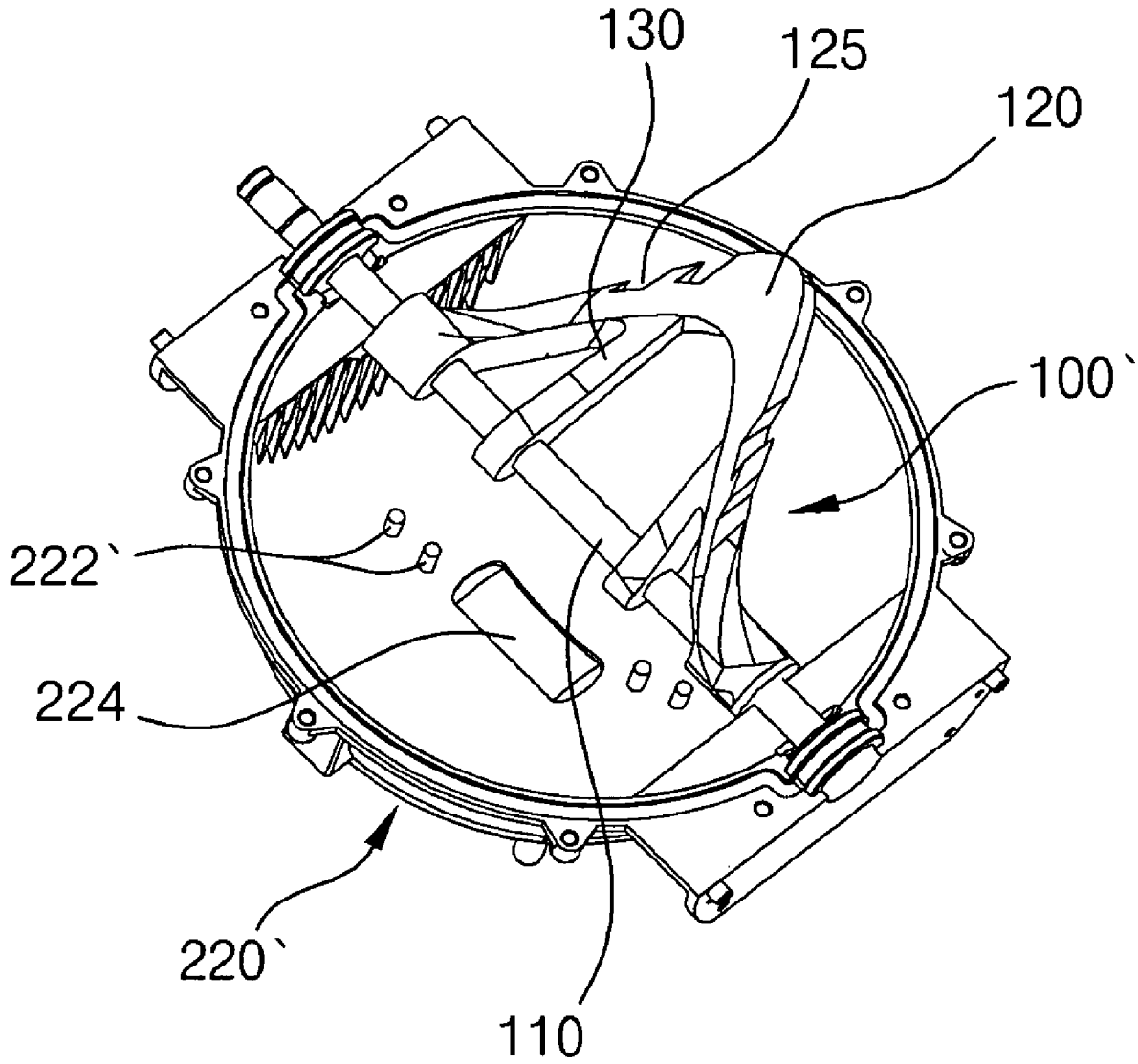
[FIG. 14]

PULVERIZER FOR FOOD WASTE TREATMENT APPARATUS

BACKGROUND OF THE INVENTION

1. Field of the Invention

The present invention relates generally to a pulverizer for a food waste treatment apparatus and, more particularly, to a pulverizer for a food waste treatment apparatus in which a spiral pulverizing screw is provided in a spherical body to reliably agitate and pulverize food waste, and an exhaust channel unit is provided on the spherical body to effectively vent exhaust gas generated by the treatment of food waste.

2. Description of the Related Art

Generally, every house, restaurant, etc. discharges a predetermined amount of food waste everyday. Typically, such food waste is dumped after only water is removed from the food waste using a filter or the like. This conventional food waste treatment method increases the amount of food waste. If dumped food waste is not frequently treated, odors may result, with the result that the surrounding air is polluted.

To effectively reduce and recycle food waste, the development of a food waste treatment apparatus for home use which can solve the above problems is in demand. Generally, a food waste treatment apparatus which is coupled to the domestic sink of a kitchen counter removes water from food waste and reduces the volume of the food waste through a series of processes including dehydration, cutting and drying, thus reducing the amount of food waste discharged.

Food waste treatment apparatuses are classified into a variety of different kinds according to the method of treating food waste, and they are classified into a variety of different kinds according to the use thereof.

Furthermore, in conventional food waste treatment apparatuses, according to the orientation of a rotating shaft and the shape of a pulverizer, they may be classified into the vertical cylindrical type pulverizer and the horizontal cylindrical type pulverizer.

In the case of the vertical cylindrical type pulverizer, when treating food waste, a relatively low load is applied to a motor which operates a pulverizing screw to pulverize the food waste. Hence, a low-noise design can be realized. However, because the pulverizing screw is provided on the lower portion of the apparatus, food waste may not be evenly agitated or pulverized, with the result that a grain size of pulverized food waste is relatively large and food waste undesirably lumps at the central portion of the pulverizing screw and thus may not be pulverized. Furthermore, since a heater for drying food waste is provided in the lower portion of the apparatus, pulverizing and drying performance is reduced. On the other hand, the ratio of the volume occupied by the pulverizing screw is low, so that the amount of input food waste in relation to the overall size of the apparatus can be increased.

In the horizontal cylindrical type pulverizer, because a pulverizing screw for pulverizing food waste extends for the entire length of a pulverizer, food waste can be satisfactorily agitated and pulverized. Furthermore, a heater for drying food waste is provided along the cylindrical surface of the pulverizer, so that heat can be efficiently transferred to the food waste, thus increasing the efficiency of drying. However, pulverization of food waste is focused on both ends of the pulverizing screw (that is, on both ends of the pulverizer). In addition, a large quantity of food waste is compressed by the rotation of the pulverizing screw. Thereby, an overload is applied to the pulverizing screw, with the result that it may become stopped. Furthermore, there is a disadvantage in that the amount of food waste which can be input into the pulverizer is reduced because of the large volume ratio occupied by the pulverizing screw related to the volume of the pulverizer.

Moreover, neither the vertical cylindrical type pulverizer nor the horizontal cylindrical type pulverizer has a separate gas exhaust structure for effectively exhausting gas generated in the pulverizer. Thus, odors which result from the process of treating the food waste may be disagreeable to the user.

SUMMARY OF THE INVENTION

Accordingly, the present invention has been made keeping in mind the above problems occurring in the prior art, and an object of the present invention is to provide a pulverizer for food waste apparatuses which has a spherical body and is constructed such that a spiral pulverizing screw is provided in the spherical body, thus more effectively agitating and pulverizing food waste input into the pulverizer, and minimizing remnants of food waste in the pulverizer, thereby reducing power consumption and preventing noise.

In an aspect, the present invention provides a pulverizer of a food waste treatment apparatus, including: a main body having a hollow space therein; a pulverizing screw, comprising: a rotating shaft installed in the main body so as to be rotatable; and at least one drive blade extending from the rotating shaft; and an exhaust channel unit coupled to an upper end of the main body, the exhaust channel unit having an annular shape, with an intake hole and an exhaust hole formed through an outer surface of the exhaust channel unit.

At least one spiral guide vane may be provided in the exhaust channel unit to guide gas so that the gas input into the exhaust channel unit through the intake hole circulates through the exhaust channel unit and is exhausted to outside through the exhaust hole.

The main body may comprise a hollow spherical body.

The intake hole may comprise a plurality of intake holes formed in an inner circumference of a lower portion of the exhaust channel unit at positions spaced apart from each other at regular intervals. Each intake hole may have a polygonal, elliptical or circular shape.

The exhaust hole may comprise a plurality of exhaust holes formed in an outer circumference of a lower portion of the exhaust channel unit at positions spaced apart from each other at regular intervals. Each exhaust hole may have a polygonal, elliptical or circular shape.

The guide vane may be in a plate shape of a predetermined thickness.

The guide vane may extend a predetermined length from the intake hole in a clockwise or counterclockwise direction in the exhaust channel unit.

The drive blade may extend from a circumferential outer surface of a first end of the rotating shaft in a spiral shape surrounding the rotating shaft in a clockwise or counterclockwise direction and be connected to a circumferential outer surface of a second end of the rotating shaft.

The drive blade may extend continuously from the outer surface of the first end of the rotating shaft to the outer surface of the second end thereof.

Furthermore, a space may be defined between the drive blade and the rotating shaft in a radial direction.

In addition, a medial portion of the drive blade may be farther from the rotating shaft than are other portions thereof.

The pulverizer may further include a support bar provided on a medial portion of the rotating shaft to support the pulverizing screw.

As well, a cutting piece may be provided on an outer cutting edge of the drive blade in the radial direction of the main body. The cutting piece may have a predetermined thickness.

Furthermore, pulverizing ribs may protrude inwards from a circumferential inner surface of the main body. Each pulverizing rib may have a predetermined length.

The pulverizing ribs may are spaced apart from each other, and each pulverizing rib may have depressions therein. An imaginary line connecting the depressions of the pulverizing ribs to each other may form an arc line on the circumferential inner surface of the main body in a direction making an angle with respect to the pulverizing ribs.

The cutting piece may be movable on the circumferential inner surface of the main body along the imaginary line connecting the depressions of the pulverizing ribs.

A cutting notch having a predetermined depth may be formed in an outer cutting edge of the drive blade in a radial direction of the main body, and a pulverizing protrusion may be provided on the inner surface of the main body, so that when the drive blade rotates, food waste is pulverized by reciprocal action between the cutting notch and the pulverizing protrusion.

In another aspect, the present invention provides a pulverizer of a food waste treatment apparatus, including: a main body having a hollow space therein; a pulverizing screw, comprising: a rotating shaft installed in the main body so as to be rotatable; and at least one drive blade extending from the rotating shaft; and a cover removably provided on an upper end of the main body.

The cover has a funnel shape increasing in diameter from a bottom thereof to a top thereof, with slits formed in a lower portion of the cover at regular angular intervals. The cover is made of elastic material so that the cover is flexible.

The pulverizer may further include an exhaust channel unit coupled to an upper end of the main body, the exhaust channel unit having a hollow annular shape, with an intake hole and an exhaust hole formed in an outer surface of the exhaust channel unit. The cover may include: an annular cover frame removably coupled to the exhaust channel unit, the annular cover frame having an annular shape, with a coupling protrusion provided under a lower surface of the annular cover frame; and a plurality of elastic plates extending inwards from an inner circumference of the annular cover frame, the elastic plates being spaced apart from each other at regular angular intervals with the slits interposed therebetween so that the elastic plates can elastically be extended and contracted.

The cover may be made of soft silicone.

Furthermore, at least one spiral guide vane may be provided in the exhaust channel unit to guide gas such that the gas input into the exhaust channel unit through the intake hole circulates through the exhaust channel unit and is exhausted to outside through the exhaust hole.

The main body may comprise a hollow spherical body.

The drive blade may extend from a circumferential outer surface of a first end of the rotating shaft in a shape surrounding the rotating shaft in a clockwise or counterclockwise direction and is connected to a circumferential outer surface of a second end of the rotating shaft.

In addition, a space may be defined between the drive blade and the rotating shaft in a radial direction.

As well, a cutting piece may be provided on an outer cutting edge of the drive blade in the radial direction of the main body. The cutting piece may have a predetermined thickness.

The drive blade may rotate in the main body in such a manner that a predetermined distance is maintained between the drive blade and a circumferential inner surface of the main body, thus preventing the drive blade from being impeded by the inner surface of the pulverizing casing. The drive blade may extend continuously from a first end of the rotating shaft to a second end thereof. Here, a medial portion of the drive blade may be farther from the rotating shaft than are other portions thereof.

An outlet may be formed in a lower end of a central portion of the main body. The outlet may be openable and closable and be opened to discharge food waste from the main body.

The outlet may be closable and openable by a valve control unit.

Furthermore, a vibration-proof structure may be provided in the lower end of the main body to prevent noise and vibration during operation of the pulverizer.

In addition, a motor unit may be coupled to one end of the rotating shaft through a gear to supply rotating force to the rotating shaft.

Moreover, a cutting notch having a predetermined depth may be formed in an outer cutting edge of the drive blade in a radial direction of the main body, and a pulverizing protrusion may be provided on the inner surface of the main body, so that when the drive blade rotates, food waste is pulverized by reciprocal action between the cutting notch and the pulverizing protrusion.

BRIEF DESCRIPTION OF THE DRAWINGS

The above and other objects, features and advantages of the present invention will be more clearly understood from the following detailed description taken in conjunction with the accompanying drawings, in which:

FIG. 1 is an exploded perspective view of a pulverizer for a food waste treatment apparatus, according to a first embodiment of the present invention;

FIG. 2 is an upper perspective view of a pulverizer for a food waste treatment apparatus, according to a first embodiment of the present invention;

FIG. 3 is a bottom perspective view of the pulverizer of FIG. 2;

FIG. 4 is a plan view illustrating the pulverizer of FIG. 2;

FIG. 5 is a front view illustrating the pulverizer of FIG. 2;

FIG. 6 is a right side view illustrating the pulverizer of FIG. 2;

FIG. 7 is a bottom view illustrating the pulverizer of FIG. 2;

FIG. 8 is a sectional view taken along the line A-A of FIG. 2;

FIG. 9 is a sectional view taken along the line B-B of FIG. 2;

FIG. 10 is a partially broken perspective view of the pulverizer which illustrates the internal construction thereof according to the first embodiment of the present invention;

FIG. 11 is a view of the pulverizer of FIG. 10 seen along the C axis;

FIG. 12 is a perspective view illustrating a cover and an exhaust channel unit of the pulverizer according to the first embodiment of the present invention;

FIG. 13 is a perspective view of a lower pulverizing casing which illustrates the internal construction of the pulverizer according to the present invention; and FIG. 14 is a perspective view of a pulverizing screw and a lower pulverizing casing of a pulverizer, according to a second embodiment of the present invention.

DESCRIPTION OF THE PREFERRED EMBODIMENTS

Hereinafter, a pulverizer for food waste treatment apparatuses according to preferred embodiments of the present invention will be described in detail with reference to the attached drawings.

A first embodiment of the present invention will be described in detail with reference to the related drawings.

FIG. 1 is an exploded perspective view of the pulverizer for food waste treatment apparatuses, according to the first embodiment of the present invention. FIG. 2 is an upper perspective view of a pulverizer for a food waste treatment apparatus, according to a first embodiment of the present invention. FIG. 3 is a bottom perspective view of the pulverizer of FIG. 2. FIG. 4 is a plan view illustrating the pulverizer of FIG. 2. FIG. 5 is a front view illustrating the pulverizer of FIG. 2. FIG. 6 is a right side view illustrating the pulverizer of FIG. 2. FIG. 7 is a bottom view illustrating the pulverizer of FIG. 2.

Referring to FIGS. 1 through 7, the pulverizer according to the first embodiment of the present invention includes a hollow pulverizing casing 200, a pulverizing screw 100 which is installed in the pulverizing casing 200 so as to be rotatable, an exhaust channel unit 300 which is coupled to the upper end of the pulverizing casing 200, a cover 400 which is removably provided above the upper end of the pulverizing casing 200, and a valve control unit 500 which is provided under the pulverizing casing 200.

In the pulverizer for food waste treatment apparatuses according to the present invention, the pulverizing screw 100 pulverizes food waste input into the pulverizing casing 200. A drying heater may be provided on the circumferential outer surface or the upper end of the pulverizing casing 200 to dry food waste while it is being pulverized.

The pulverizing casing 200 is a hollow unit which has an internal space of predetermined volume so as to contain a predetermined amount of food waste input thereinto. Preferably, the pulverizing casing 200 has a spherical shape. The pulverizing casing 200 is divided into the upper pulverizing casing 210 and a lower pulverizing casing 220 to facilitate the installation of the pulverizing screw 100. Furthermore, it is preferable that the upper and lower pulverizing casings 210 and 220 be manufactured in hemispherical shapes for convenience of manufacture. Typically, they can be formed by molding to ensure the solidity.

The upper pulverizing casing 210 includes an upper body 211 having a hemispheric shape, and a hollow cylindrical input port 216 which extends a predetermined length upwards from the upper end of the upper body 211. Furthermore, a circumferential bent portion 214 is formed by the junction between the input port 216 and the upper body 211. The bent portion 214, along with a drive blade 120, functions to cut food waste in such a way that the drive blade 120 crosses over the bent portion 214 in a state of being spaced apart from the bent portion 214 by a predetermined distance.

The lower pulverizing casing 220 comprises a lower body 221 having a hemispheric shape. A circular seating depression 223 is formed in the surface of the junction of the lower pulverizing casing 220 with the upper pulverizing casing 210. A packing 230 is inserted into the seating depression 223. The packing 230 functions to seal the upper and lower pulverizing casings 210 and 220 after they are assembled with each other, thus preventing food waste from leaking from the pulverizing casing 200.

On the junction between the upper and lower pulverizing casings 210 and 220, first fastening parts 217 are provided around the circumference of the upper pulverizing casing 210 at positions spaced apart from each other at regular intervals, and second fastening parts 227 are provided around the circumference of the lower pulverizing casing 220 at positions spaced apart from each other at regular intervals. To couple the upper and lower pulverizing casings 210 and 220 to each other, coupling bolts (not shown) are tightened into the fastening parts 217 and 227.

Meanwhile, an inlet 210*a* is formed in the upper end of the outer surface of the upper pulverizing casing 210. As necessary, an outlet 224 may be formed in the lower portion of the outer surface of the lower pulverizing casing 220. The outlet 224 may be configured so as to be openable using the valve control unit 500. The valve control unit 500 may be electrically operated.

To enable a user to easily input dehydrated and cut food waste into the pulverizing casing 200, the inlet 210*a* has an appropriate size and is formed in the upper end of the pulverizing casing 200 which is parallel to the support surface. Pulverizing ribs 222 protrude inwards from the circumferential inner surface of the pulverizing casing 200. The pulverizing ribs 222 function to pulverize food waste together with the pulverizing screw 100. The pulverizing ribs 222 are evenly distributed on the inner surfaces of the upper and lower pulverizing casings 210 and 220. Each pulverizing rib 222 may have a plate shape which has a predetermined thickness and sharp edges. The shape of the pulverizing rib 222 is not limited to the above-mentioned shape but may adopt other structures.

Preferably, the pulverizing casing 200 is made of metal which has a relatively high heat transfer rate and is manufactured by molding. Typically, stainless steel can be used as the material of the pulverizing casing 200. More preferably, the pulverizing casing 200 may be coated with molybdenum to prevent remnants of food waste from getting stuck to the surface thereof. Molybdenum is used in anodes, as a grid or a support of an electron tube, a contact point of an electric circuit, a high-temperature resistance portion of a heat-resistance substance, a special alloy, a heating wire, coating material, etc. Molybdenum is mechanically very strong under conditions of very low or high temperature as well as at room temperature, and the use of molybdenum as a material applied to stainless steel is increasing lately.

Here, of course, the material applied to the pulverizing casing 200 is not limited to molybdenum. That is, the pulverizing casing 200 can be coated with any material, so long as it can prevent remnants of food waste from sticking to the surface of the pulverizing casing 200. Furthermore, the pulverizing screw 100 is also coated with molybdenum such that remnants of food waste are prevented from being stuck thereto. Therefore, the treatment operation of the pulverizer can be more reliably conducted.

In the present invention, a vibration-proof structure (not shown) may be provided in the lower end of the pulverizing casing 200 to prevent noise and vibration from occurring during operation of the pulverizer. The vibration-proof structure may include an impact or vibration absorber, such as a coil or a damper, to prevent vertical or horizontal vibration.

FIG. 12 is a perspective view illustrating the cover 400 and the exhaust channel unit 300 of the pulverizer according to the first embodiment of the present invention. Hereinafter, the exhaust channel unit 300 will be explained in detail with reference to FIGS. 1 through 7 and 12.

The exhaust channel unit 300 has a hollow tunnel shape. Preferably, the exhaust channel unit 300 includes a hollow channel body 310 having a donut or ring shape. Intake holes 320 and exhaust holes 340 are formed in the outer surface of the channel body 310. The exhaust channel unit 300 is coupled to the upper end of the pulverizing casing 200. In detail, the exhaust channel unit 300 may be fastened to an upper end of input port 216 of the upper pulverizing casing 210.

The intake holes 320 have polygonal, elliptical or circular shapes and may be formed in the inner circumference of the lower portion of the exhaust channel unit 300 at positions spaced apart from each other at regular intervals. In terms of space utilization, it is preferable that the intake holes 320 have elliptical shapes and be arranged along the inner circumference of the lower portion of the exhaust channel unit 300. The exhaust holes 340 have polygonal, elliptical or circular shapes and are formed in the outer circumference of the lower portion of the exhaust channel unit 300 at positions spaced apart from each other at regular intervals. Each exhaust hole 340 may be defined by a cylindrical structure which protrudes a predetermined length downwards from the surface of the exhaust channel unit 300. In the exhaust channel unit 300, gas drawn through the intake holes 320 circulates through the exhaust channel unit 300 and is thereafter exhausted outside through the exhaust holes 340.

Referring to FIGS. 1 and 12, one or more spiral guide vanes 330 are provided in the exhaust channel unit 300. Each guide vane 330 extends a predetermined length from the corresponding intake hole 320 in a clockwise or counterclockwise direction in the exhaust channel unit 300. The guide vane 330 may comprise a plate which has a predetermined thickness and a predetermined curvature.

Furthermore, each guide vane 330 is oriented from the intake hole 320 in a direction between the circumferential direction and the radial direction of the exhaust channel unit 300. In other words, the guide vanes 330 are arranged in the exhaust channel unit 300 in a shape similar to a waterwheel or a pinwheel.

Hereinafter, the cover 400 will be explained in detail with reference to FIGS. 1 through 7 and 12. The cover 400 is removably provided above the pulverizing casing 200. In detail, coupling protrusions 450 are provided under the lower surface of the cover 400, and coupling holes 350 are formed in the exhaust channel unit 300. Thus, the cover 400 is removably coupled to the exhaust channel unit 300 above the pulverizing casing 200 in such a manner as to insert the coupling protrusions 450 of the cover 400 into the corresponding coupling holes 350 of the exhaust channel unit 300. The number of coupling holes 350 matches that the number of the coupling protrusions 450. For example, four pairs of coupling holes 350 and coupling protrusions 450 may be provided.

The cover 400 includes an annular cover frame 410 which has the coupling protrusions 450 under the lower surface thereof and is separably coupled to the exhaust channel unit 300, and elastic plates 420 which extend inwards from the inner circumference of the annular cover frame 410. The elastic plates 420 are spaced apart from each other at regular intervals, and the spaces between the elastic plates 420 can be elastically extended and contracted.

The elastic plates 420 define the lower part of the cover 400 and form a funnel shape which has slits at regular angular intervals. Furthermore, the elastic plates 420 are made of elastic material and are thus flexible. That is, the elastic plates 420 each of which has a fan shape are arranged adjacent to each other to form a circular shape. Here, the elastic plates 420 are spaced apart from each other at regular intervals 430 to prevent them from interfering with each other. In other words, the elastic plates 420 have a shape which is increased in diameter from the bottom to the top. The coupling protrusions 450 extend downwards from the lower surface of the cover frame 410.

In addition, in the cover 400 whose diameter becomes narrower going from the top to the bottom, an opening 440 is formed a portion at which the lower ends of the elastic plates 420 are gathered. Due to the opening 440, the elastic plates 420 can freely move upwards and downwards. As such, so that the cover 400 can elastically move, it is preferably made of soft silicone.

The operation and function of the cover 400 and the exhaust channel unit 300 will be explained with reference to FIGS. 8 and 12.

Gas generated when food waste is treated in the pulverizing casing 200 is pushed upwards by the rotation of the pulverizing screw 100. Here, since the drive blade 120 has a spiral shape, gas moves upwards in an inclined direction in the pulverizing casing 200, as shown by the arrow referred to by the reference numeral 240. In process of the gas moving upwards, the elastic plates 420 of the cover 400 function to prevent gas from being directly discharged outside the cover 400.

That is, because the elastic plates 420 are arranged in a shape in which they are inclined from the circumferential outer surface of the pulverizing casing 200 inwards and downwards, gas moves along the elastic plate 420 towards the center of the pulverizing casing 200. Thereby, eddies 250 occur around the lower ends of the elastic plates 420, thus preventing gas from leaking out of the pulverizing casing 200 through the opening 440.

Meanwhile, when the pulverizing casing 200 is filled with food waste, the elastic plate 420 of the cover 400 can no longer extend or contract. Hence, the opening 440 formed in the lower end of the cover 400 serves as an input limiting line. Furthermore, because of the inclined elastic plates 420, not only exhaust gas but also food waste treated in the pulverizing casing 200 can be prevented from moving out of the upper end of the pulverizing casing 200.

As shown in FIG. 12, in the exhaust channel unit 300, while exhaust gas drawn into the exhaust channel unit 300 through the intake holes 320 is guided by the guide vanes 330 and circulates through the exhaust channel unit 300, the gas can cool naturally. Furthermore, to increase gas exhaust efficiency during the above process, the exhaust channel unit 300 creates a swirling vortex of the gas. Thereafter, the gas is discharged from the exhaust channel unit 300 through the exhaust hole 340 and is drawn into a deodorization unit or the like for post-treatment.

FIG. 8 is a sectional view taken along the line A-A of FIG. 2. FIG. 9 is a sectional view taken along the line B-B of FIG. 2. FIG. 10 is a partially broken perspective view of the pulverizer which illustrates the internal construction thereof according to the first embodiment of the present invention. FIG. 11 is a view of the pulverizer of FIG. 10 seen along the C axis.

Hereinafter, the pulverizing screw 100 of the pulverizer according to the present invention will be explained in detail with reference to FIGS. 8 through 11.

The pulverizing screw 100 includes a rotating shaft 110 and at least one drive blade 120 which extends from the rotating shaft 110 in a spiral shape. The drive blade 120 rotates in the spherical pulverizing casing 200 in such a manner as to maintain a state of being spaced apart from the inner surface of the pulverizing casing 200 by a predetermined distance to prevent the drive blade 120 from being impeded by the pulverizing casing 200. In detail, the drive blade 120 extends from a circumferential outer surface of a first end of the rotating shaft 110 in a shape surrounding the rotating shaft 110 in a clockwise or counterclockwise direction and is connected to a circumferential outer surface of a second end of the rotating shaft 110. In the embodiment, the drive blade 120 surrounds the rotating shaft 110 in a spiral shape at an angle of 360°. In the installation of the drive blade 120, a space 121 is defined between the rotating shaft 110 and the drive blade 120.

Cylindrical rotating bodies 112, 114 and 116 are fitted over the circumferential outer surface of the rotating shaft 110. The medial rotating body 112 is disposed at the medial position of the rotating shaft 110. The first side rotating body 114 and the second side rotating body 116 are respectively disposed at the first and second ends 111 and 119 of the rotating shaft 110. A hole is formed through each of the rotating bodies 112, 114 and 116 along a longitudinal central axis thereof, so that the rotating shaft 110 is inserted into the holes of the rotating bodies 112, 114 and 116.

The drive blade 120 extends from the outer surface of the first side rotating body 114 to the outer surface of the second side rotating body 116. In other words, the drive blade 120 is configured such that it is continuous from the outer surface of the first end of the rotating shaft 110 to the outer surface of the second end thereof. A support bar 130 extends from the medial rotating body 112 in the radial direction of the rotating shaft 110. The support bar 130 functions to stably support the drive blade 120 on the rotating shaft 110. That is, the support bar 130 is provided on the medial portion of the rotating shaft 110 and serves to support the entire pulverizing screw 100.

The rotating shaft 110 and the rotating bodies 112, 114 and 116 may be integrally formed into a single body or, alternatively, they may be manufactured through separate processes and assembled to each other so as to be separable. In the case of the integrated structure, they may be formed by molding. In the separable structure, the production cost is reduced, and even if a part is damaged, it can be easily replaced with a new one. In addition, the drive blade 120 and the support bar 130 may be also integrally formed with the rotating bodies 112, 114 and 116 or, alternatively, they may be manufactured through separate processes and be separably assembled to each other. In the same manner, in the integrated structure, they may be formed by molding.

Cutting pieces 122 are provided on an outer cutting edge of the drive blade 120. Each cutting piece 122 has a predetermined thickness and extends a predetermined length in the radial direction of the rotating shaft 110. The cutting pieces 122, acting in concert with the inner surface of the pulverizing casing 200, serve to evenly pulverize food waste. Here, the cutting pieces 122 cross over the bent portion 214 in such a manner as to maintain the state of being spaced apart from the bent portion 214 by a predetermined distance, thus cutting relatively large food waste which was input into the pulverizing casing 200.

Meanwhile, the pulverizing ribs 222 are provided on the inner surface of the lower pulverizing casing 220. Preferably, the pulverizing ribs 222 protrude inwards from the inner surface of the lower pulverizing casing 220 and are spaced apart from each other at regular intervals.

The cutting pieces 122 must maintain the state of being spaced apart from the pulverizing ribs 222 by predetermined distances to avoid interference therebetween. While the drive blade 120 rotates, the outer cutting edge and cutting pieces 122 of the drive blade 120 cross over the inner surface of the pulverizing casing 200, thus pulverizing food waste.

As shown in FIG. 9, the medial portion of the drive blade 120 is farther from the rotating shaft 110 than are other portions. In other words, with regard to the shape in which the drive blade 120 extends from the rotating shaft 110 in a spiral shape, the distance between the drive blade 120 and the rotating shaft 110 is increased from the first end of the drive blade 120 to the medial portion thereof, and the distance therebetween is reduced again from the medial portion of the drive blade 120 to the second end thereof. In the drawing, the reference numeral 140 denotes the distance from the central axis of the rotating shaft 110 to the medial portion of the drive blade 120.

Due to the structural characteristics of the pulverizing screw 100, when the pulverizing screw 100 rotates, the medial portion of the drive blade 120 holds and lifts food waste which is at the lowermost position in the lower body 221. As such, in the process of treating food waste, food waste which is gathered on the lower portion in the pulverizing casing 200 can be continuously moved upwards by the pulverizing screw 100, thus being evenly agitated. Therefore, the pulverization and agitation of food waste in the pulverizing casing 200 can be smoothly and reliably conducted. Furthermore, because the space 121 is defined between the drive blade 120 and the rotating shaft 110, when the drive blade 120 holds and lifts food waste, food waste over a proper amount naturally falls onto the lower portion of the lower body 221 through the space 121. Thereby, overload is prevented from being applied to a power supply means (not shown) for driving the drive blade 120.

Meanwhile, to install the pulverizing screw 100 in the lower pulverizing casing 220, a first support mount 228 is provided on the lower pulverizing casing 220 at a first end of the junction surface thereof with the upper pulverizing casing 210, and a second support mount 229 is provided on the lower pulverizing casing 220 at a second end of the junction surface. The first end 111 and the second end 119 of the rotating shaft 110 are respectively inserted so as to be rotatable into insert holes formed in the first and second support mounts 228 and 229. A bearing may be provided in each insert hole of the first and second support mounts 228 and 229 to ensure smooth rotation. In addition, the power supply means (not shown), such as a motor, is connected to the second end 119 of the rotating shaft 110 to supply power thereto.

The rotating shaft 110 receives power from the power supply means (not shown) and transmits the rotating force to the drive blade 120 such that the pulverizing screw 100 is able to rotate in the pulverizing casing 200.

FIG. 13 is a perspective view of the lower pulverizing casing which illustrates the internal construction of the pulverizer according to the present invention. Hereinafter, the relationship between the drive blade 120 and the inner surface of the pulverizing casing 200 will be explained with reference to FIGS. 10 through 13.

Referring to FIG. 13, the pulverizing ribs 222 are provided on the inner surface of the lower pulverizing casing 220. It is preferable that the pulverizing ribs 222 protrude inwards from the inner surface of the lower pulverizing casing 220 and be spaced apart from each other by regular intervals.

Two adjacent pulverizing ribs 222*a* and 222*b* will be explained as an example. A first depression 225*a* extending a predetermined distance is formed in the first pulverizing rib 222*a*. A second depression 225*b* extending a predetermined distance is formed in the second pulverizing rib 222*b*. Preferably, several depressions 225*a*, 225*b* are formed in each pulverizing rib 222*a*, 222*b*. As shown by the reference numeral 226, an imaginary line connecting the centers of the depressions 225*a* and 225*b* to each other forms an arc line on the circumferential inner surface of the lower body in the direction angled to the pulverizing ribs 222*a* and 222*b*. That is, as can be understood from the imaginary line 226, the first depressions 225*a* and the second depressions 225*b* are located at positions misaligned from each other.

When the pulverizing screw 100 rotates in the pulverizing casing 200, the cutting pieces 122 of the drive blade 120 conduct circular orbital motion along the imaginary lines 226. In this process, the cutting pieces 122 scrape remnants of food waste off between the pulverizing ribs 222 while the pulverizer is in operation. Furthermore, the drying operation can also be conducted while pulverizing food waste. Thus, because the cutting pieces 122 scrape food waste while or after the food waste is dried, the food waste which has been stuck to the inner surface of the pulverizing casing 200 can more easily and reliably removed therefrom.

Hereinafter, the valve control unit 500 will be explained with reference to FIGS. 1 and 9.

The valve control unit 500 includes a valve assembly 520, an outlet support frame 530 and a valve packing 510. The valve assembly 520 includes a semi-cylindrical valve 522 which has a depression therein, and support shafts 524 which are provided on both ends of the semi-cylindrical valve 522. The outlet support frame 530 is attached to the lower surface of the pulverizing casing 200 around the outlet 224. Seating depressions 531 into which the support shafts 524 are seated are formed in both ends of the outlet support frame 530. An opening corresponding to the outlet 224 is formed through the central portion of the outlet support frame 530. The valve packing 510 is interposed between the valve assembly 520 and the outlet support frame 530 to seal the space therebetween.

The operation of the valve control unit 500 will be explained with reference to FIG. 9. When the treatment of food waste is completed, the operation of the valve control unit 500 is controlled by the signal of a controller (not shown). Under normal conditions, the valve assembly 520 of the valve control unit 500 closes the outlet 224 of the pulverizing casing 200 and maintains this state. When the treatment of food waste is completed, the controller operates the valve assembly 520, that is, rotates it by a predetermined angle. In other words, because the valve 522 of the valve assembly 520 has a semi-cylindrical shape, when the valve 522 is oriented level with the bottom surface of the pulverizing casing 200 which defines the outlet 224 therein, the outlet 224 is closed by the valve 522, but when the valve 522 is rotated by a predetermined angle relative to the bottom surface of the pulverizing casing 200, the outlet 224 is open.

When the outlet 224 is in the open state, the food waste being moved by the rotation of the pulverizing screw 100 is discharged to outside through the outlet 224. Here, because the pulverizing casing 200 has a spherical shape, the food waste can be smoothly moved to the outlet 224 which is formed in the center of the lower portion of the pulverizing casing 200. Therefore, remnants of food waste are prevented from becoming fixed in or around the pulverizing casing 200, thus preventing contamination of the pulverizer or the surroundings thereof, and preventing damage to the pulverizer.

FIG. 14 is a perspective view of a pulverizing screw 100' and a lower pulverizing casing 220' of a pulverizer, according to a second embodiment of the present invention. Hereinafter, the pulverizing screw 100' and the lower pulverizing casing 220' according to the second embodiment will be described in detail with reference to FIG. 14.

In the second embodiment, cutting notches 125 having predetermined depths are formed in an outer cutting edge of a drive blade 120 constituting the pulverizing screw 100'. The shape of each cutting notch 125 is determined along a circumference of an imaginary circle which is defined around the central axis of a rotating shaft 110 and has a predetermined radius. In other words, according to the intended purposes of a designer, various numbers of cutting notches 125 may be formed in the drive blade 120 along the circumferences of imaginary concentric circles which are formed around the central axis of the rotating shaft 110 and have different radii.

Pulverizing protrusions 222' corresponding to the cutting notches 125 of the drive blade 120 are provided on the circumferential inner surface of the lower pulverizing casing 220'. The pulverizing protrusions 222' are provided on at least one concentric circle at positions spaced apart from each other at regular or irregular intervals.

When the pulverizing screw 100' rotates in the pulverizing casing 200, the pulverizing protrusions 222' pass through the cutting notches 125. As such, because the pulverizing protrusions 222' are on the moving track of the cutting notches 125, food waste which is held by the cutting notches 125 can be reliably pulverized by the rotation of the pulverizing screw 100'. Preferably, cutting edges may be formed on the inner surface of the cutting notches 125.

As described above, in the pulverizer for food waste treatment apparatuses according to the present invention, a pulverizing screw having a spiral blade is installed in a spherical pulverizing casing, so that food waste input into the pulverizer can be evenly distributed and pulverized, thus enhancing the operational efficiency of the pulverizer, and reducing power consumption.

Furthermore, an annular exhaust channel unit and a funnel-shaped cover are provided above the upper end of the pulverizing casing, so that odors or remnants of food waste which result during the process of treating the food waste are prevented from leaking through the open upper end of the pulverizing casing as opposed to being discharged to outside through an outlet of the pulverizing casing.

In addition, the present invention provides a functional combination type pulverizer which takes advantage of the vertical type pulverizer and the horizontal type pulverizer, thus solving the problems of the conventional pulverizers. In other words, the present invention can minimize the problems of remnants of food waste becoming stuck to the inner surface of the pulverizer or some of the food waste being left in the pulverizer after the food waste is discharged therefrom, which are problems which commonly result from using the conventional vertical type pulverizer and the conventional horizontal type pulverizer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Furthermore, these modifications, additions and substitutions should be regarded as falling within the bounds of the present invention.

What is claimed is:

1. A pulverizer of a food waste treatment apparatus, comprising:

a main body having a hollow space therein;

a pulverizing screw, comprising: a rotating shaft installed in the main body so as to be rotatable; and at least one drive blade extending from the rotating shaft; and an exhaust channel unit coupled to an upper end of the main body, the exhaust channel unit having an annular shape, with an intake hole and an exhaust hole formed through an outer surface of the exhaust channel unit.

2. The pulverizer as set forth in claim 1, wherein at least one spiral guide vane is provided in the exhaust channel unit to guide gas so that the gas input into the exhaust channel unit through the intake hole circulates through the exhaust channel unit and is exhausted to outside through the exhaust hole.

3. The pulverizer as set forth in claim 1 or 2, wherein the main body comprises a hollow spherical body.

4. The pulverizer as set forth in claim 3, wherein the intake hole comprises a plurality of intake holes formed in an inner circumference of a lower portion of the exhaust channel unit at positions spaced apart from each other at regular intervals, each of the plurality of intake holes having a polygonal, elliptical or circular shape.

5. The pulverizer as set forth in claim 4, wherein the guide vane is in a plate shape of a predetermined thickness.

6. The pulverizer as set forth in claim 3, wherein the exhaust hole comprises a plurality of exhaust holes formed in an outer circumference of a lower portion of the exhaust channel unit at positions spaced apart from each other at regular intervals, each of the plurality of exhaust holes having a polygonal, elliptical or circular shape.

7. The pulverizer as set forth in claim 5, wherein the guide vane extends a predetermined length from the intake hole in a clockwise or counterclockwise direction in the exhaust channel unit.

8. The pulverizer as set forth in claim 1 or 2, wherein the drive blade extends from a circumferential outer surface of a first end of the rotating shaft in a spiral shape surrounding the rotating shaft in a clockwise or counterclockwise direction and is connected to a circumferential outer surface of a second end of the rotating shaft.

9. The pulverizer as set forth in claim 8, wherein the drive blade extends continuously from the outer surface of the first end of the rotating shaft to the outer surface of the second end thereof.

10. The pulverizer as set forth in claim 9, wherein a space is defined between the drive blade and the rotating shaft in a radial direction.

11. The pulverizer as set forth in claim 8, wherein a medial portion of the drive blade is farther from the rotating shaft than are other portions thereof.

12. The pulverizer as set forth in claim 8, further comprising:

a support bar provided on a medial portion of the rotating shaft to support the pulverizing screw.

13. The pulverizer as set forth in claim 8, wherein a cutting piece is provided on an outer cutting edge of the drive blade in the radial direction of the main body, the cutting piece having a predetermined thickness.

14. The pulverizer as set forth in claim 13, wherein pulverizing ribs protrude inwards from a circumferential inner surface of the main body, each of the pulverizing ribs having a predetermined length.

15. The pulverizer as set forth in claim 14, wherein the pulverizing ribs are spaced apart from each other, and each of the pulverizing ribs has depressions therein, wherein an imaginary line connecting the depressions of the pulverizing ribs to each other forms an arc line on the circumferential inner surface of the main body in a direction making an angle with respect to the pulverizing ribs.

16. The pulverizer as set forth in claim 15, wherein the cutting piece is movable on the circumferential inner surface of the main body along the imaginary line connecting the depressions of the pulverizing ribs.

17. The pulverizer as set forth in claim 8, wherein a cutting notch having a predetermined depth is formed in an outer cutting edge of the drive blade in a radial direction of the main body, and when the drive blade rotates, pulverizing protrusions provided on the inner surface of the main body pass through the cutting notches, so that food waste is pulverized between the cutting notches and the pulverizing protrusions.

* * * * *